United States Patent [19]

Roig et al.

[11] Patent Number: 5,044,522

[45] Date of Patent: Sep. 3, 1991

[54] SHAMPOO DISPENSER

[76] Inventors: Miguel Roig, 410-25 St., Union City, N.J. 07087; George Spector, 233 Broadway, New York, N.Y. 10007

[21] Appl. No.: 486,888

[22] Filed: Mar. 1, 1990

[51] Int. Cl.[5] ..... B67D 1/16; B67D 5/06

[52] U.S. Cl. ..... 222/108; 211/119; 222/132; 222/181; 222/192; 4/605

[58] Field of Search ..... 222/129, 132, 144.5, 222/181, 108, 505, 248, 312, 380; 211/113, 119, 88, 95; 4/605

[56] References Cited

U.S. PATENT DOCUMENTS

| | | | |
|---|---|---|---|
| 3,078,016 | 2/1963 | Judy | 222/181 |
| 4,387,811 | 6/1983 | Ragir et al. | 211/119 |
| 4,548,340 | 10/1985 | Messer | 222/181 |
| 4,880,145 | 11/1989 | McManus | 222/181 |

*Primary Examiner*—Kevin P. Shaver

[57] ABSTRACT

A shower dispenser is provided and consists of a container which can be suspended from a shower head arm. A plurality of nozzles are each fluidly connected into each of a plurality of compartments in the container for dispensing different liquids therefrom when manually operated. A plurality of filler ports on top of the container each have a flap closure for sealing after the liquids are poured into the compartments.

1 Claim, 1 Drawing Sheet

SHAMPOO DISPENSER

BACKGROUND OF THE INVENTION

The instant invention relates generally to dispensing devices and more specifically it relates to a shower dispenser which provides liquids easily and neatly dispensed therefrom.

There are available various conventional dispensing devices which do not provide the novel improvements of the invention herein disclosed.

SUMMARY OF THE INVENTION

A primary object of the present invention is to provide a shower dispenser that will overcome the shortcomings of the prior art devices.

Another object is to provide a shower dispenser in which liquids or gels can be easily and neatly dispensed from the individual containers of the unit at the push of a button.

An additional object is to provide a shower dispenser that allows easy access to a variety of shampoos and conditioners.

A further object is to provide a shower dispenser that is simple and easy to use.

A still further object is to provide a shower dispenser that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS FIGURES

DETAILED DESCRIPTION OF THE PREFERRED EMBODIMENTS

Figure 1:
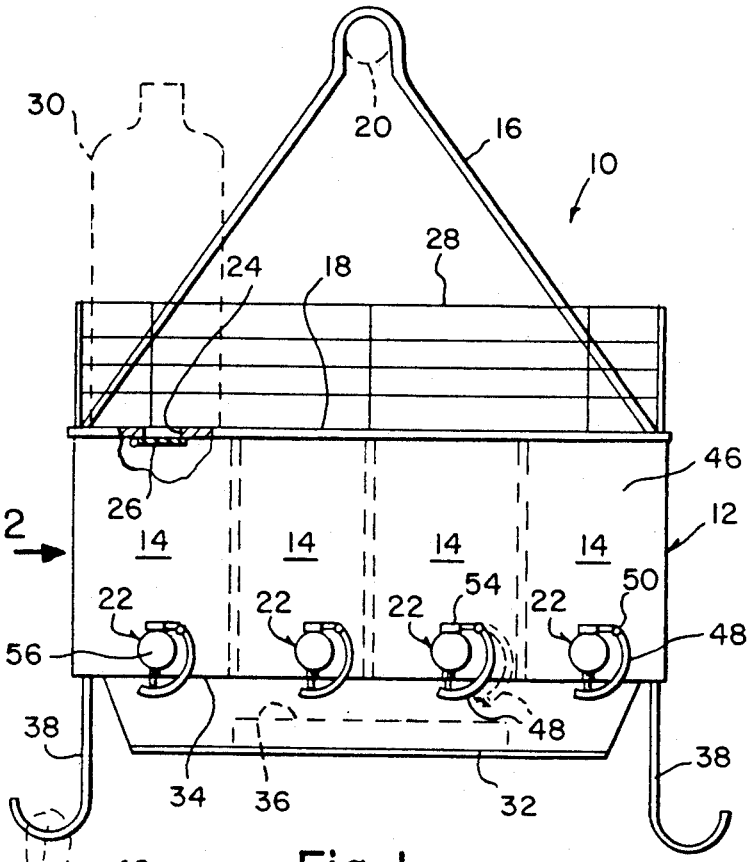
FIG. 1 is a front view of the invention.
Figure 2:
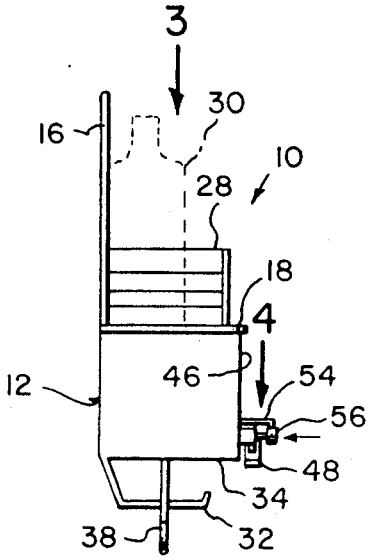
FIG. 2 is a side view taken in direction of arrow 2 in FIG. 1.
Figure 3:
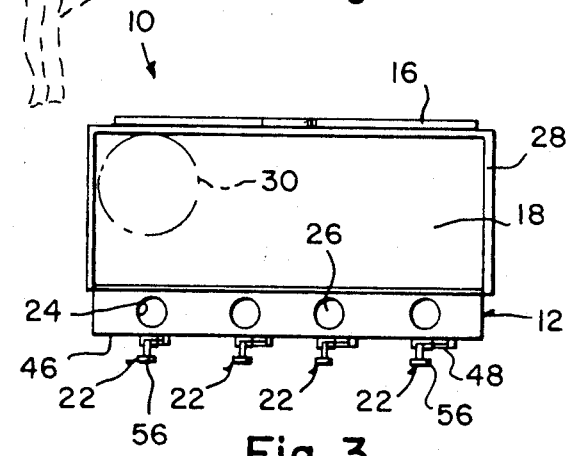
FIG. 3 is a top view taken in direction of arrow 3 in FIG. 2.

Turning now descriptively to the drawings, in which similar reference characters denote similar elements throughout the several views, FIGS. 1 through 3 illustrate a shower dispenser 10 consisting of a container 12 having a plurality of compartments 14 for holding a different liquid, such as shampoos, conditioners or the like in each of the compartments 14. A holder 16 extends from top 18 of the container 12 to suspend the container from a shower head arm 20. A nozzle 22 is fluidly connected to each compartment 14 in the container 12 for dispensing the liquid therefrom when manually operated. Filler ports 24 are on the top 18 of the container 12 above each of the compartments 14. A flap closure 26 is located in each filler port 24 for sealing after the liquids are poured into the compartments 14.

A retaining enclosure 28 is carried on the top 18 of the container 12 for holding items 30, such as bottles and tubes, therein to prevent the items 30 from falling therefrom. A soap tray 32 is carried on bottom 34 of the container 12 for supporting a bar of soap 36 therein. A hook members 38 is suspended from the bottom 34 of the container 12 on each side of the soap tray 32 so that wash cloths 40 and the like can be hung thereon.

Figure 4:
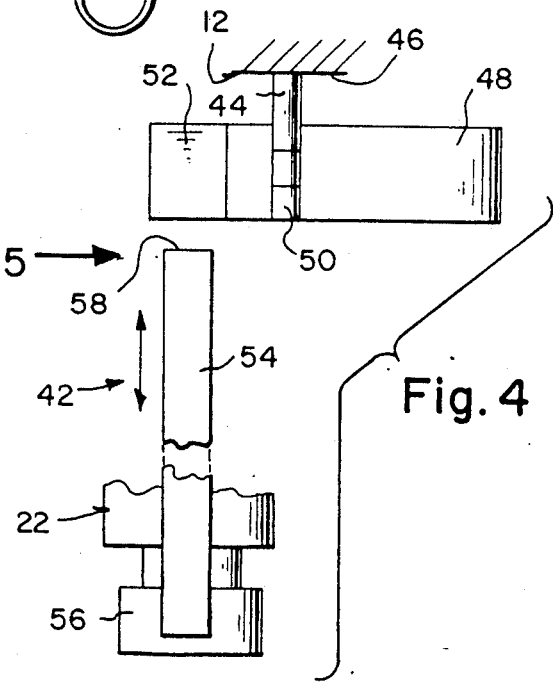
FIG. 4 is an enlarged top view of the drip catcher release mechanism taken in direction of arrow 4 in FIG. 2, in which a finger from the nozzle will engage with a wedge rotating the drip catcher when the nozzle is depressed.
Figure 5:
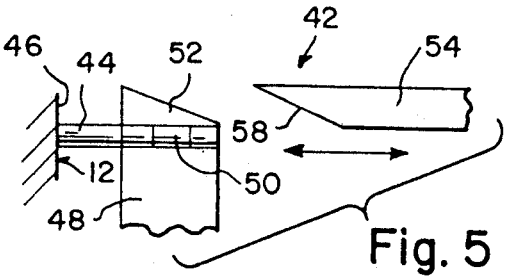
FIG. 5 is a side view taken in direction of arrow 5 in FIG. 4.

FIGS. 4 and 5 best show a drip catcher release mechanism 42 for each nozzle 22 consisting of a post 44 extending from front 46 of the container 12. A curved drip catcher 48 is pivotly connected at 50 to the post 44 for catching the liquid drops from the nozzle 22 when not in use. A wedge 52 is connected to top edge of the drip catcher 48 on opposite side thereof.

A finger 54 is connected to the dispensing button 56 of the nozzle 22. The finger 54 has a slanted tip 58. When the dispensing button 56 is pressed inwardly, the slanted tip 58 of the finger 54 will engage with the wedge 52 causing the drip catcher 48 to pivot about 50 and move away from the nozzle 22 thus allowing the fluid to exit freely therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A shower dispenser comprising:

a) a container having a plurality of compartments for holding a different liquid in each of said compartments;

b) a holder extending from top of said container to suspend said container from a shower head arm;

c) a plurality if nozzles, each fluidly connected to each of said compartments in said container for dispensing the liquid therefrom when manually operated;

d) a plurality of filler ports on the top of said container, each being above each of said compartments; and e) a plurality of flap closures, each located in each of said filler ports for sealing after the liquids are poured into said compartments; further including a retaining enclosure carried on the top of said container for holding various items therein to prevent the items from falling therefrom; further including a soap tray carried on bottom of said container for supporting a bar of soap therein; further including a pair of hook members each suspended from the bottom of said container on either side of said soap tray so that wash cloth and the like can be hung thereon; further including a drip catcher release mechanism for each nozzle comprising;

f) a post extending from front of said container;

g) a curved drip catcher pivotly connected to said post for catching the liquid drops from said nozzle when not in use;

h) a wedge connected to top edge of said drip catcher on opposite side thereof; and i) a finger connected to the dispensing button of said nozzle, said finger having a slanted tip, which when the dispensing button is pressed inwardly, the slanted tip of said finger will engage with said wedge causing said drip catcher to pivot thereabout and move away from said nozzle thus allowing the fluid to exit freely therefrom.

* * * * *